US010625759B2

(12) United States Patent
Nitti

(10) Patent No.: US 10,625,759 B2
(45) Date of Patent: Apr. 21, 2020

(54) METHOD FOR CONTROLLING A TRAIN OF WORKING VEHICLES FOR RAILWAY MAINTENANCE

(71) Applicant: TESMEC S.P.A., Milan (IT)

(72) Inventor: Antonio Nitti, Castellana Grotte (IT)

(73) Assignee: TESMEC S.P.A., Milan (IT)

( * ) Notice: Subject to any disclaimer, the term of this patent is extended or adjusted under 35 U.S.C. 154(b) by 187 days.

(21) Appl. No.: 15/774,903

(22) PCT Filed: Jul. 26, 2016

(86) PCT No.: PCT/IB2016/054448

§ 371 (c)(1),
(2) Date: May 9, 2018

(87) PCT Pub. No.: WO2017/089905

PCT Pub. Date: Jun. 1, 2017

(65) Prior Publication Data

US 2018/0327006 A1 Nov. 15, 2018

(30) Foreign Application Priority Data

Nov. 25, 2015 (IT) ..... 102015000076512

(51) Int. Cl.
*B61L 3/00* (2006.01)
*B61L 15/00* (2006.01)

(52) U.S. Cl.
CPC ..... *B61L 3/008* (2013.01); *B61L 15/0036* (2013.01)

(58) Field of Classification Search
CPC ..... B61L 3/008; B61L 15/0036; B61L 27/00; B60T 7/126

(Continued)

(56) References Cited

U.S. PATENT DOCUMENTS 6,263,266 B1 * 7/2001 Hawthorne ..... G09B 9/048 701/19
2011/0015807 A1 * 1/2011 Young ..... B60K 6/46 701/2

FOREIGN PATENT DOCUMENTS

CN 101654112 A 2/2010
CN 102991536 A * 3/2013
KR 20110009381 A 1/2011

* cited by examiner

*Primary Examiner* — Isaac G Smith
(74) *Attorney, Agent, or Firm* — King & Schickli, PLLC

(57) ABSTRACT

A method for controlling a train (10) of railway working vehicles (11) comprising at least two railway working vehicles (11) forming a railway train (10); each of said at least two railway working vehicles (11) comprises a multi-function vehicle bus MVB (20), and a wired train bus WTB (12), which enables connection of said multifunction vehicle buses MVB (20) of said at least two railway working vehicles (11); said multifunction vehicle bus MVB (20) comprises: a train-communication-network TCN port (14)7 which connects said wired train bus WTB (12) to said multifunction vehicle bus MVB (20); a traction control (22) of the means; and a translator (21), which connects said TCN port (14) to said traction control (22); said method being characterized in that: each vehicle of the train writes its own maximum speed on its own TCN port (14); the maximum speed of the train is defined as the lowest of the maximum speeds defined on the TCN ports (14) by the individual vehicles; the master vehicle activates the traction control handle; the master vehicle sends on the TCN port (14) the predefined speed lower than or equal to the maximum speed of the train that is to be reached according to the setting of the traction handle; and all the vehicles of the train detect the pre-set speed that is to be reached and contribute to traction (Continued)

Figure 1:
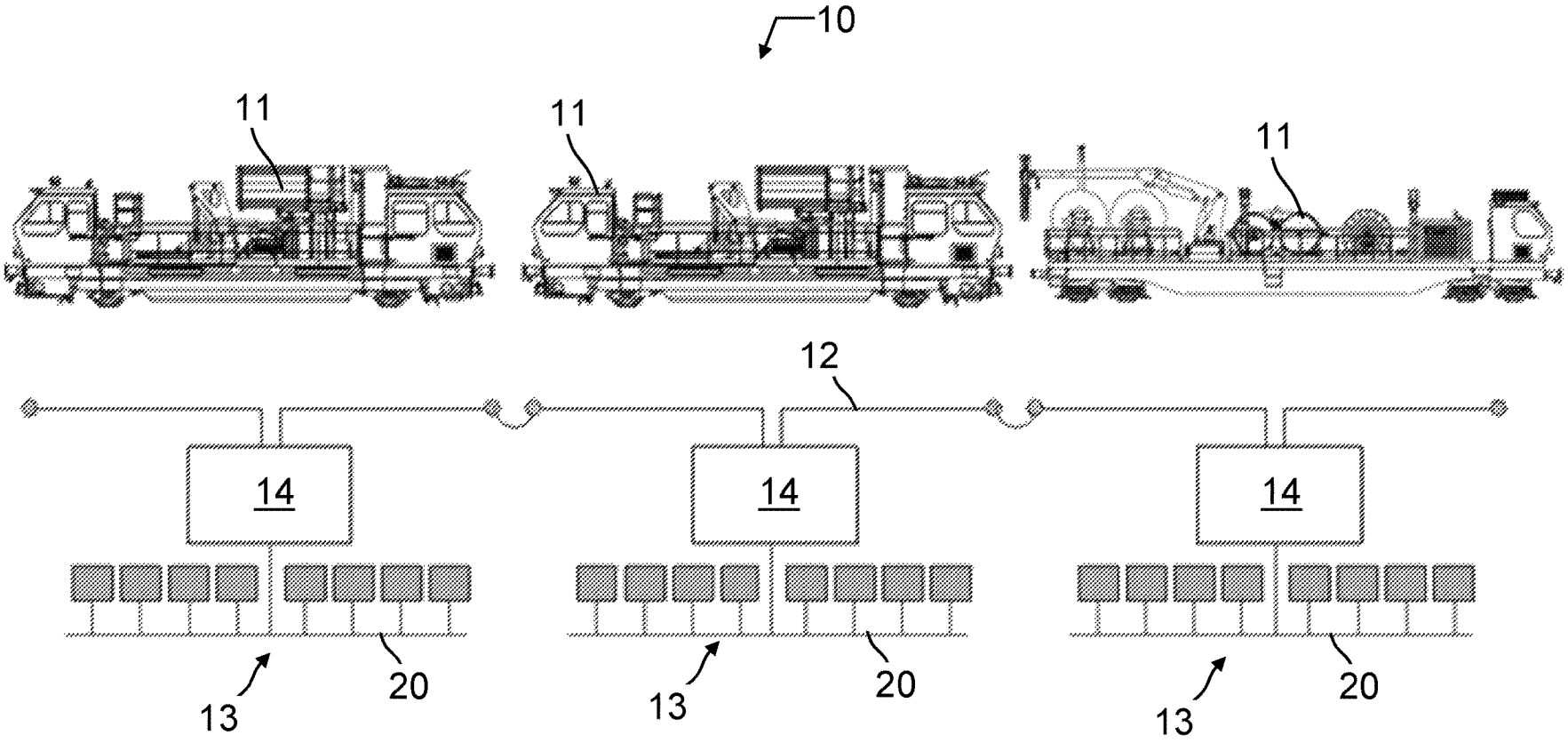

until said speed is reached, regulating their speeds with torques that may even differ from one vehicle to another.

6 Claims, 2 Drawing Sheets

(58) Field of Classification Search
USPC ..... 701/19, 20
See application file for complete search history.

METHOD FOR CONTROLLING A TRAIN OF WORKING VEHICLES FOR RAILWAY MAINTENANCE

TECHNICAL FIELD

The present invention relates to a method for controlling a train of working vehicles for railway maintenance (also known as "railway repair vehicles") and more in particular to a method for remote control and multiple control of traction of multiple railway vehicles.

BACKGROUND

Multiple railway vehicles are classified on the basis of the power source used, and may be of two types: electric multiple units (EMU), and diesel multiple units (DMU).

The latter type can in turn be divided on the basis of the type of transmission: diesel-electric multiple units (DEMU), diesel-mechanical multiple units (DMMU), and diesel-hydraulic multiple units (DHMU).

SUMMARY

Multiple railway vehicles are widely used as passenger vehicles and are characterized by a homogeneous composition of the train since they use vehicles of one and the same type (DMU or EMU) and of one and the same vehicle model.

Management and architecture of the electronic signals is regulated by the relevant railway standards, such as IEC61375-1, UIC556, and UIC647.

The communication system of a railway vehicle (DMU, EMU, high-speed trains, locomotives, passenger trains, trams, etc.) envisages integration of the parameters of the various functions and is organized with a purposely designed standard architecture, a communication protocol, and safety levels of the data exchanged for ensuring interoperability of the vehicles.

Working vehicles (i.e., not passenger vehicles) used for installation of new railway lines or for maintenance of existing ones, as likewise catenary-installation railway cars, catenary-maintenance units, rail-maintenance vehicles, etc., which have dedicated functions, have also dedicated commands and frequently do not meet the standards used for normal railway vehicles.

There hence arises the need, for the purposes of applying a management of a similar type of the parameters of traction, braking, and various alarms, to develop a method for remote control and multiple control of traction that can be applied also to working vehicles of different manufacturers and that are equipped with transmissions of different types.

According to the present invention, the above and further aims are achieved by a method for controlling a train of railway working vehicles comprising at least two railway working vehicles forming a railway train; each of said at least two railway working vehicles comprises a multifunction vehicle bus (MVB), and a wired train bus (WTB), which enables connection of said multifunction vehicle buses (MVB) of said at least two railway working vehicles; said multifunction vehicle bus -(MVB) comprises: a TCN port, which connects said wired train bus (WTB) with said multifunction vehicle bus (MVB); a traction control of the means; and a translator, which connects said TCN port to said traction control; said method being characterized in that: each vehicle of the train writes its own maximum speed on its own TCN port; the maximum speed of the train is defined as the lowest of the maximum speeds defined on the TCN ports by the individual vehicles; the master vehicle activates the traction control handle; the master vehicle sends on the TCN port the predefined speed lower than or equal to the maximum speed of the train that is to be reached according to the setting of the traction handle; and all the vehicles of the train detect the pre-set speed that is to be reached and contribute to traction until said speed is reached, regulating their speeds with torques that may also differ from one vehicle to another.

Further characteristics of the invention are described in the dependent claims.

The advantages of this solution over solutions according to the prior art are multiple.

Application of the invention will enable:

- greater flexibility of operation of the train;
- versatility of the composition of the train (with the possibility of coupling vehicles having different types of traction);
- easy and fast displacement of the means on the railway (reducing the times of displacement of the means between worksites);
- increase in performance of the vehicles coupled together (enhancement of the pulling capacity); and
- economy of use of the vehicle fleet by the customer.

BRIEF DESCRIPTION OF THE DRAWING FIGURES

Figure 2:
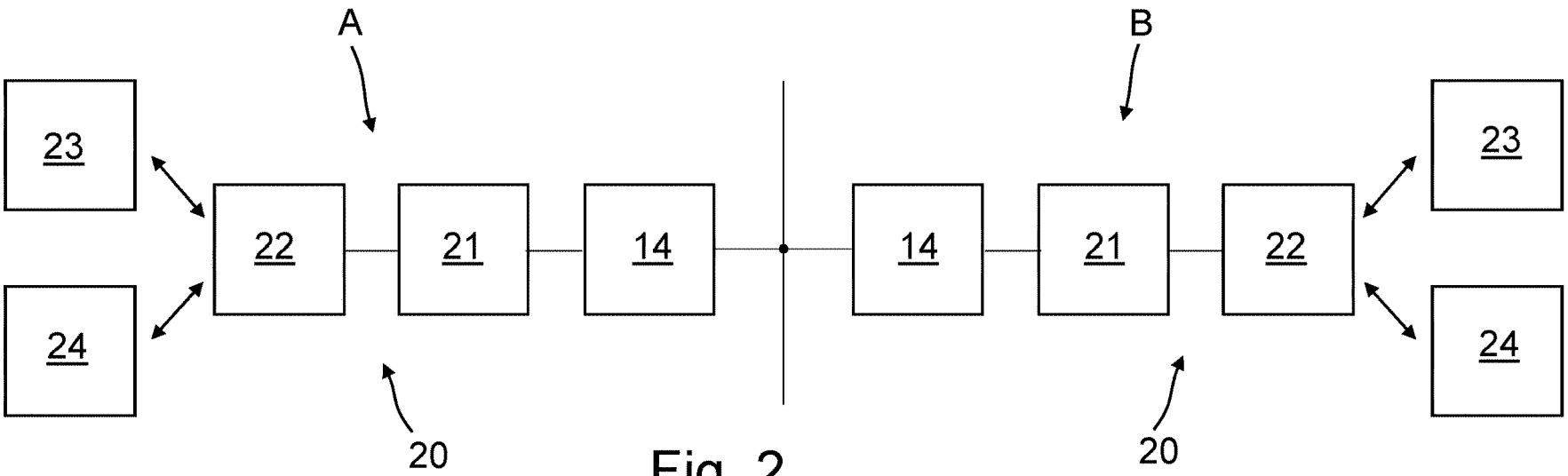

The characteristics and advantages of the present invention will emerge clearly from the ensuing detailed description of a practical embodiment thereof, which is illustrated by way of non-limiting example in the annexed drawings, wherein:

FIG. 1 is a schematic illustration of a WTB connection between different vehicles, according to the present invention; and FIG. 2 shows a block diagram of an MVB connection between two different vehicles, according to the present invention.

DETAILED DESCRIPTION OF THE INVENTION

The train bus is defined by the IEC 61375-1 standard. This standard defines the train communication network (TCN), which includes the wired train bus (WTB), which communicates with the multifunction vehicle bus (MVB).

In the case in point, we have a train 10 formed by a plurality of railway working vehicles 11.

For them, a wired train bus (WTB) 12 is created, which connects the various devices and controls 13 present on the vehicle by means of a TCN port 14.

The system for remote control and multiple control of traction according to the present invention is preferably provided with two TCN ports 14, operating in redundancy.

When the vehicle performs the role of master of the train composition, it guarantees traction of the train, whereas when it performs the role of slave of the composition, it guarantees remotization of the alarms produced.

The control system of the means enables management of traction and of the remote alarms and of the alarms originating from the vehicles in the composition and sent via the wired train bus (WTB) to the means when it performs the role of master vehicle of the composition, via the diagnostic terminal of the driving bench.

The remote-control function and any possible interruption of the lines of the wired train bus (WTB) must be diagnosed, and the diagnostics produced is integrated in the diagnostic system of the means.

The architecture of the train bus envisages duplication of the transmission means, by means of two separate backbones for the train communication network (wired train bus).

The wired train bus (WTB) 12 interfaces with a multifunction vehicle bus (MVB) 20, as indicated in the block diagram of FIG. 2, which represents the entire control process between two vehicles A and B under multiple control.

Each vehicle is provided with two TCN ports 14, where in the figure just one of them is represented.

In the event of malfunctioning of the active TCN port 14, redundancy switching from the active node to the resting node takes place in an autonomous way within a maximum time of one second.

The TCN port 14 has the function of exchanging information between the wired train bus and the multifunction vehicle bus. The data and parameters are exchanged by means of standard telegrams defined by the relevant standards.

Among the main functions of the TCN port 14 there is network inauguration, through which all the vehicles present in the train are identified and there are defined the main parameters with which traction under multiple control is performed and managed.

Each vehicle makes available to the TCN port 14 its own characteristics and a series of parameters useful for traction under multiple control.

If in the composition the vehicle is in master configuration, it must guarantee traction of the train, whereas, when it performs the role of slave, it must guarantee remotization of the alarms produced.

The role of "translation" of the information that each vehicle must transmit or receive through the remote control is carried out by means of a translator 21.

The translator 21 makes available to the TCN port 14 the machine parameters and the traction requests translated into the standard of the remote control.

Likewise, the translator 21 makes available to the traction control system the information received from the TCN port 14 translated into the standard of the multifunction vehicle bus 20.

The translator 21 functions as interface between the remote control system and the traction control 22 of the means, which comprises a traction processor 23 and a device manager 24.

The traction control system of the vehicle has a hardware and a communication system that are totally independent and practically unique for each vehicle present in the train, and hence the translator 21 is designed to function as interface with the remote control system.

The translator 21 has a controller-area-network (CAN) interface with which it communicates and exchanges standard identifiers with the TCN port 14.

Management of traction under multiple control is performed through execution of some commands on the master vehicles transferred to the slave vehicles of the train. The slave vehicles communicate that the commands have been executed and transfer onto the wired train bus a series of information useful for traction. The commands transferred under multiple control are regulated by the functions defined in the UIC647 standard.

Each vehicle present in the train is able to manage the communications transmitted and received by its own TCN ports 14 for the functions of traction listed below:

turning-on/turning-off of the diesel engine,
control of battery charge,
parking mode,
control of parking brake,
directions of travel.

Each command is set on the master means of the train. The TCN port 14 makes it available for the entire train via telegrams defined in the UIC556 standard.

Each means of the train manages its own traction assuming as reference some parameters available on the TCN port 14 after network inauguration.

Described in a simplified way hereinafter are the steps that determine management of the speed of traction of the vehicles forming the train.

1) All the vehicles of the train write the value of the their maximum speed on the their TCN port 14. The value is received by the traction control 22 and translated by the translator 21.

2) The maximum speed of the train (maximum speed that can be reached) is defined (by the TCN port 14 during inauguration) as the lowest of the maximum speeds defined on the TCN ports 14 by the individual vehicles. The maximum speed appears automatically on the display of all the means that make up the train.

3) The vehicle that after inauguration has the role of master has the traction control handle active. The master vehicle sends (via the translator 21) on the TCN port 14 the predefined speed that is to be reached as a function of the position of the traction handle. The predefined speed appears automatically on the display of the TCN port 14 of all the means that make up the train.

4) All the vehicles of the train detect the pre-set speed (read on the TCN port 14, translated by the translator 21, and sent to the traction control 22) that is to be reached and contribute to traction until said speed is reached, regulating their speeds with torques that may even differ from one vehicle to another (according to the characteristics of the individual means). All the vehicles of the train detect the instantaneous speed on the TCN port 14 (translated by the translator 21 and sent to the traction control 22). The instantaneous speed on the TCN port 14 of each vehicle is generated by the master vehicle (sent by the traction control and translated by the translator 21).

5) The target speed may be lower than, and at the most equal to, the maximum speed.

6) After each vehicle has detected the target speed, before starting traction, it must ascertain that the telegram "Traction Ready" of all the slave vehicles of the train is ON. For the master vehicle the telegram "Traction Ready" is not envisaged since, if the master vehicle is unable to generate traction, it sends on the TCN port 14 a pre-set speed value equal to 0.

7) Each vehicle verifies the telegrams containing the information "Emergency Off" coming from the master means and from all the slave means.

8) Each slave means uses the telegram "Traction blocked" for inhibiting traction of the train in a case different from the ones indicated previously.

For example, if the maximum speed of the various means of the train is 70 km/h, 90 km/h, and 100 km/h, the maximum speed of the train will be 70 km/h.

Through the traction handle of the master vehicle the desired speed is set in cruise-control mode, said speed is displayed on the display in real time, and is, for example, 35 km/h. Hence, the pre-set speed of the train is 35 km/h.

Other examples of commands that the translator 21 sends to the TCN port 14 are described hereinafter.

Commands for Engine Turning-on and Turning-off

After the master machine has received the diesel turning-on command, it turns on its own diesel engine and sends the command for turning-on the diesel engine (impulsive signal). When the slave machine reads said signal, it must turn on its own diesel engine.

After the master machine has received the diesel stop command, it turns off its own diesel engine and sends the command for turning-off of the diesel engine (impulsive signal). When the slave machine reads said signal, it must turn off its own diesel engine. All the slave machines send the state of their own diesel engines: on/off (cyclic signal). All the slave machines issue the r.p.m. of their own diesel engines, supplying a value that ranges from 0 to 100% of the maximum value (cyclic signal).

Parking brake. If the machine has the master role, it sends the command for activation/de-activation of the parking brake (cyclic command). If the machine has a master or slave role, it sends the state of the parking brake: activated/de-activated (cyclic command).

Direction of travel. If the machine has a master role and the handle is shifted to forward, the corresponding cyclic signal is sent. If the machine has a master role and the handle is shifted to reverse, the corresponding cyclic signal is issued.

The slave or master machine sees the command and sets the forward direction of travel; if the forward is successfully activated, the corresponding cyclic signal is issued.

The slave or master machine sees the command and sets the reverse direction of travel; if the reverse is successfully activated, the corresponding cyclic signal is issued.

The invention claimed is:

1. A method for controlling a train (10) of railway working vehicles (11) for railway maintenance comprising:

at least two railway working vehicles (11) forming a railway train (10); each of said at least two railway working vehicles (11) comprises a multifunction vehicle bus MVB (20), and a wired train bus WTB (12), which enables connection of said multifunction vehicle buses MVB (20) of said at least two railway working vehicles (11); said multifunction vehicle bus MVB (20) comprises: a TCN port (14), which connects said wired train bus WTB (12) to said multifunction vehicle bus MVB (20); a traction control (22); and a translator (21), which connects said TCN port (14) to said traction control (22); said method being characterized in that each vehicle of the train writes its own maximum speed on its own TCN port (14); the maximum speed of the train defined as the lowest of the maximum speeds defined on the TCN ports (14) by the individual vehicles; the master vehicle activates the traction control handle; the master vehicle sends on the TCN port (14) the predefined speed lower than or equal to the maximum speed of the train that is to be reached according to the setting of the traction handle; and all the vehicles of the train detect the pre-set speed that is to be reached and contribute to traction until said speed is reached, regulating their speeds with torques that may even differ from one vehicle to another.

2. The method according to claim 1, characterized in that, after each vehicle has detected the target speed, before applying traction to the wheels, it must ascertain that a telegram "Traction Ready" of all slave vehicles of the train is ON.

3. The method according to claim 1, characterized in that each vehicle verifies a telegram containing the information of "Emergency OFF" coming from a master vehicle and from all slave vehicles.

4. The method according to claim 3, characterized in that, in the case of a telegram of "Emergency ON", all the vehicles of the train perform a traction cut-off.

5. The method according to claim 1, characterized in that each slave vehicle uses a telegram "Traction blocked" for inhibiting traction of the train in the event of problems.

6. A method for controlling a train of railway working vehicles for railway maintenance, the train comprising at least two railway working vehicles forming a railway train; each of said at least two railway working vehicles comprising a multifunction vehicle bus, and a wired train bus, which enables connection of the multifunction vehicle buses of said at least two railway working vehicles; said multifunction vehicle bus comprising: a port, which connects said wired train bus to said multifunction vehicle bus; a traction control; and a translator, which connects said port to said traction control; said method comprising:

for each vehicle of the train, writing a maximum speed on the vehicle's own port, the maximum speed of the train defined as the lowest of the maximum speeds defined on the ports by the individual vehicles;

by way of the master vehicle, activating the traction control handle;

via the master vehicle, sending on the port a predefined speed lower than or equal to the maximum speed of the train that is to be reached according to the setting of the traction handle; and for each vehicle of the train, detecting the predefined speed that is to be reached and contributing to traction until said predefined speed is reached, and regulating a speed of each vehicle with torques that differ from one vehicle to another.

* * * * *